US005250172A

United States Patent [19]

Vargas-Gutierrez et al.

[11] Patent Number: 5,250,172

[45] Date of Patent: Oct. 5, 1993

[54] METHOD TO FABRICATE METALLIC CONTAINERS BY ELECTROPLATING FOR USE IN HOT ISOSTATIC PRESSING OF METALLIC AND/OR CERAMIC POWDERS

[76] Inventors: Gregorio Vargas-Gutierrez; Carlos Maroto-Cabrera; Horacio Villarreal-Marquez, Ave. Junco de la Vega 208 Col. Roma 64700, all of Monterrey, Nuévo Leon, Mexico

[21] Appl. No.: 925,015

[22] Filed: Aug. 5, 1992

[51] Int. Cl.[5] ..... C25D 1/10

[52] U.S. Cl. ..... 205/70

[58] Field of Search ..... 205/70

[56] References Cited

FOREIGN PATENT DOCUMENTS 1-77583 8/1991 Japan .

*Primary Examiner*—T. M. Tufariello

*Attorney, Agent, or Firm*—Laurence R. Brown

[57] ABSTRACT

Wax, alloy or plastic molds for containers used in hot isostatic pressing of metal and/or ceramic powders are surface conditioned for electroplating, coated with several metallic layers and removed from the resulting container.

5 Claims, 3 Drawing Sheets

METHOD TO FABRICATE METALLIC CONTAINERS BY ELECTROPLATING FOR USE IN HOT ISOSTATIC PRESSING OF METALLIC AND/OR CERAMIC POWDERS

BACKGROUND OF THE INVENTION

Containers produced by this method present a series of advantages as as follows thin walls, high uniformity, high ductility with no residual stresses, non-reactive with the pressed powders, high weldability, easy control of final dimensions of the product pressed, and wide applicability for complicated shapes. The as-pressed product with these containers presents high quality with no distortion or superficial defects.

The Hot Isostatic Pressing (HIP) of metallic, ceramic or combination of metallic and ceramic powders, is a standard technology in the hot consolidation of the powder metallurgy.

In this technology, the powder to be pressed is put in a container which has the shape of the mass of powders after compacting. Said container is normally degassed and hermetically sealed after filled with powders. Pressure and heat are applied to the container in all directions inside autoclaves, in such way the container is collapsed against the powder to highly densify said powders. In other words, the containers at high temperatures act as a pressure transmission media, and the powders receive the force applied to the container. Simultaneously, the applied heat produces the sintering of compacted powders.

After the HIP process, the container is removed from the compacted mass of powders which is further processed by one or more steps of finishing such as forging, machining and/or heat treatment in order to produce the desired final shape. One of the most critical elements in HIP is just the nature and characteristics of the containers used. The container, must withstand and transmit high pressures toward the mass of powders. The container must be flexible or deformable while keeping its structural integrity at high temperatures and high pressures without cracking. The container must be non-reactive with the powders being pressed and capable of hermetic sealing and in some cases vacuum evacuation without distortion. The type of container used in a HIP process, determines the dimensional precision that the final pressed part can reach.

Due to the high costs of forging and machining operations, there has been special attention given toward the development of containers for HIP process that would be able to produce compacted mass of powders with high dimensional precision and with minimum final finishing operations required.

Containers for HIP processes are made normally of glass, ceramics and metals. The type of metal is selected according to the characteristics of powders to be pressed, considering temperature and pressure needed for the HIP process and reactivity between container and powders.

For the simplest shapes as billets, bars, cylinders, etc., the surface defects produced by the welding zones are eliminated by machining increasing the cost of the pieces being processed. In complex shapes is almost impossible to eliminate such welding zones that produce surface defects. A great drawback of metallic thin wall containers, when they are produced by stamping, extrusion, deep drawing and/or welding, is that they produce distortions on the compacted mass of powders.

That is due to a non-uniform shape reduction of the container caused by the different stress accumulation produced during the container manufacturing. For that reason, the final shape so obtained will be totally different as compared with the initial container shape.

SUMMARY OF THE INVENTION

It is therefore the object of the present invention to provide a method to fabricate metallic containers to be used in the HIP process overcoming the above mentioned difficulties associated with the containers manufactured by conventional methods.

It is another object of the present invention to use a special electroplating technique to fabricate metallic containers with the following characteristics:thin walls with high uniformity no residual stresses in the container so fabricated, no welding in the container body, non-reactive surfaces, small volume, great weldability if required, exceptional dimensional precision and high fidelity in duplicating complex shapes. With containers so fabricated it is possible to predict the final dimensions of the pressed products with high accuracy and very small distortion.

Figure 1:
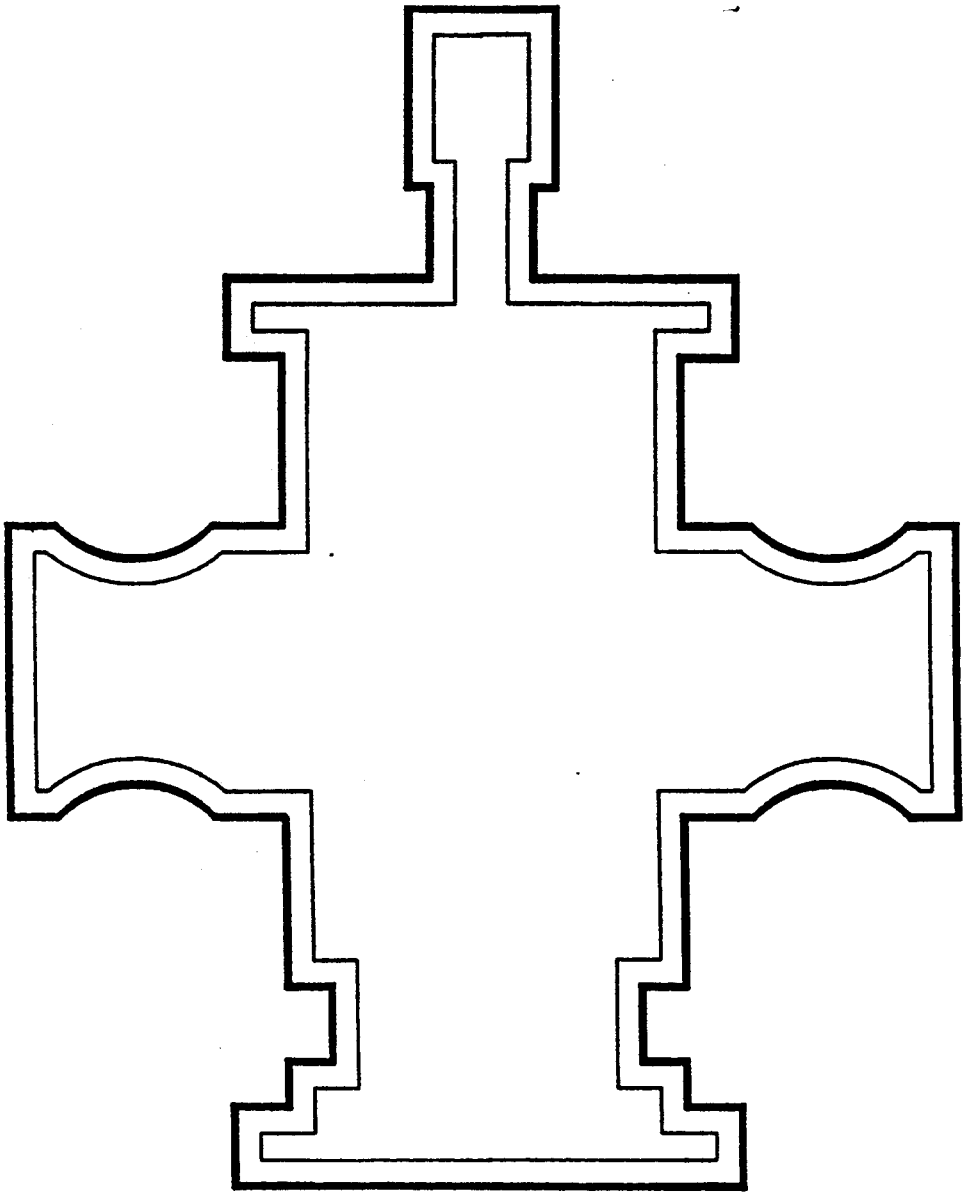
FIG. 1 shows a cross section of a metallic container made according to the present invention. The outer contour is the container before HIP process, and the inner contour is the container after HIP process.
Figure 3:
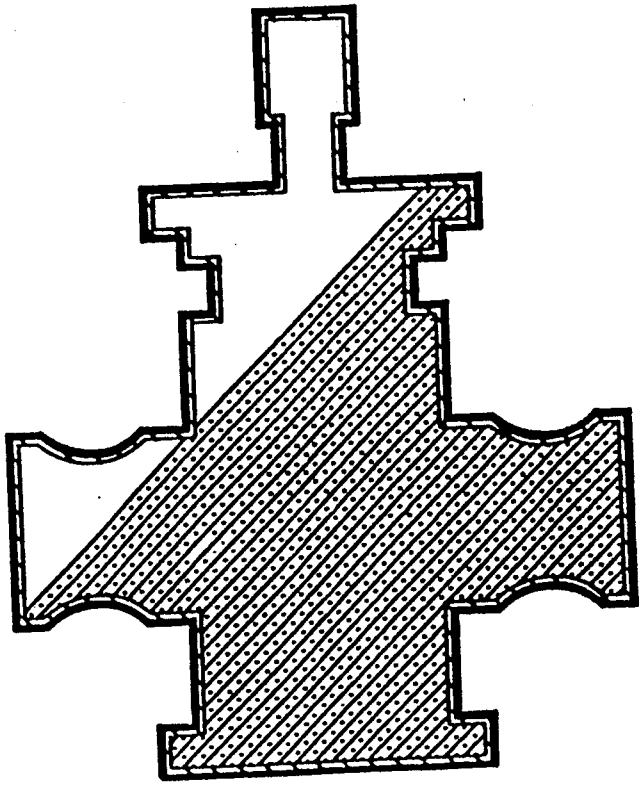
FIGS. 2 to 5 present the different stages for the container manufacturing process in a simplified way as follows.
Figure 2:
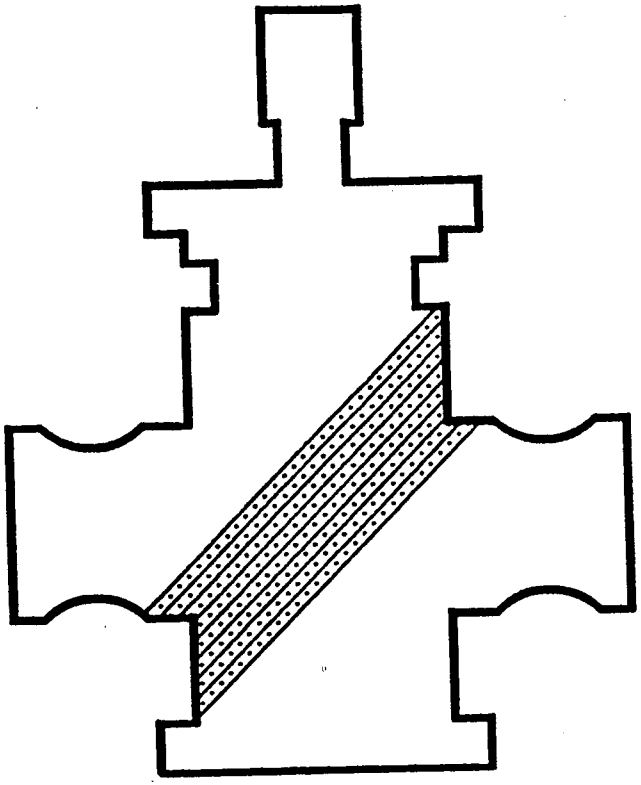
Figure 5:
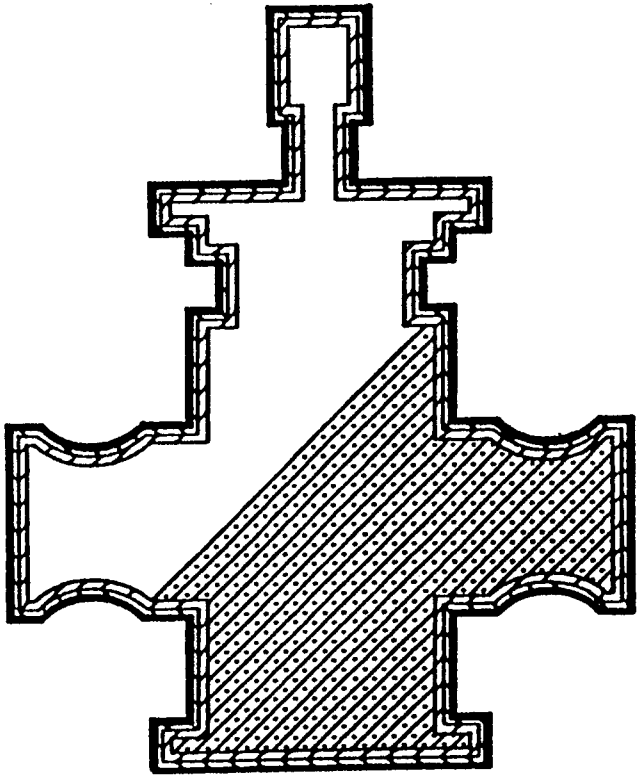
Figure 4:
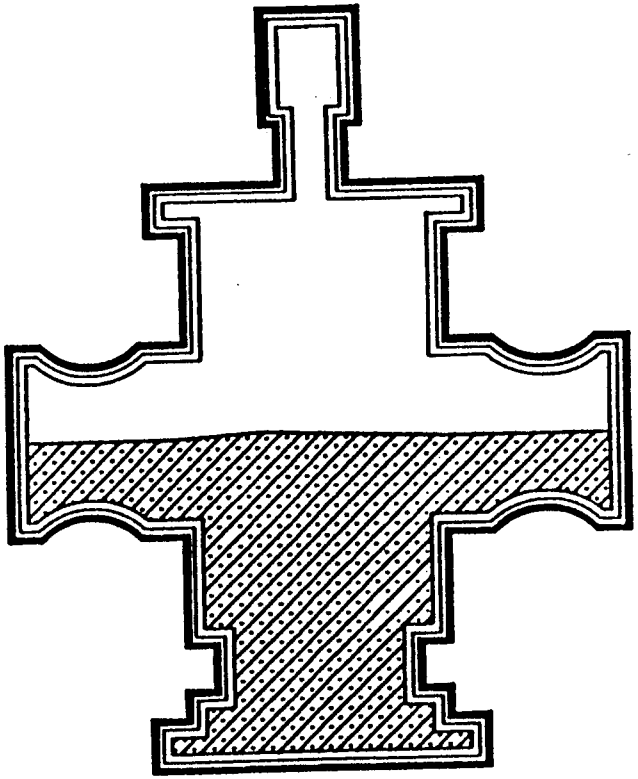

1. Design and manufacturing of the mould (FIG. 2)
2. Preparation for electroplating (FIG. 3)
3. Electroplating (FIG. 4)
4. Separation or destruction of the mould (FIG. 5)
5. Heat treatment and cleaning/finishing follows.

DESCRIPTION OF THE METHOD

The advantages of the present invention will be really appreciated as it becomes better understood. Referring more particulary to each stage of the manufacturing method of the metallic container according to the invention, the following text includes a detailed description.

1. MOLD FABRICATION

According to the geometric shape of the container to produce, it is possible to prepare the mold in two ways: permanent mold or expandable mold. Permanent mold can be used continuously for many electroplating processes. These type of moulds can be manufactured by metal casting, machining, etc. and from materials as steel, copper, rigid plastic, etc. Expandable mold, which can be used for intrincate shapes presenting several partition lines, can be made from materials as plastics, low melting point metals, waxes, glass, wood etc. Moulds can be either the positive or the negative shape of the container. Dimensions and shape of the container are determined according to the final shape to be obtained by the mass of powders.

2. PREPARATION OF MOLD FOR ELECTROPLATING

At this stage the mold surface is conditioned according to its electrical conductivity. Conductive materials are processed by conventional methods of surface finishing and cleaning either chemical or mechanical. In the case of moulds made from non-conductive materials such as waxes, glass, plastics, etc. these are processed by conventional methods in order to make their surfaces conductive depending on the base material and on the metal to electroplate.

3. ELECTROPLATING

Almost all metals are susceptible to being electroplated. Selection of metal to electroplate depends on the physico-chemical characteristics desired on the container. The electroplating process is carried out by conventional methods except by some specific variations in working parameters. That is due to the higher thickness obtained by this practice ranging from 3–5 mm. of deposit as compared with normal electrodeposits with thickness range from 0.002" to 0.005" approximately.

The specific operation parameters that are substantially different in this practice, as compared with conventional practices are: higher current densities and therefore high bath temperature, continuous bath filtering and vigorous stirring of the electroplating bath. Containers fabricated by this method can be prepared with one metallic layer or with two or more alternated different metallic layers. In the case of reactive powders to be compacted the container is prepared by electroplating a thin layer of approximately 2 micrometers with an inert metal with respect to powders followed by a thicker compatible metallic layer achieving the desired mechanical and physicochemical properties on the container. Another fabrication example is electroplating alternating layers of two or more different metals with the purpose of obtaining special mechanical properties in the container.

4. MOLD SEPARATION OR DESTRUCTION

After the electroplating process, the mold is extracted from the electroplating layer by: melting, burning, or by mechanical; or chemical media depending on the nature of the mold. In any case, the channel used for mould extraction is also used as a powder filling channel, as mentioned above said channel being independent of the product to be pressed and therefore this component can be sealed by welding after powder filling and degassing without further problems regarding residual stresses or surface defects on the workpiece.

5. CLEANING AND/OR TREATMENT

After electroplating and mold extraction, the container is subjected to a conventional cleaning procedure in order to eliminate any residue from the electroplating bath or from the mold. In the case of containers made from electroplating of iron, copper, nickel, chromium and similar metals is advisable to treat the workpiece by a thermal cycle (heat treat) by a stress relieving annealing in order to eliminate residual stresses formed during the previous stages of the process and to increase the container ductility.

We claim is:

1. A method of the manufacturing of metallic containers to be used in the hot isostatic pressing of metallic or ceramic powders or a combination of said powders, which consists of the following steps:

a) manufacturing of a mold of special design which has the shape and dimensions as required in the metallic container to produce a solid mold of materials selected from the group consisting of: waxes, low melting point alloys and plastics;

b) surface conditioning of the mold by a conventional method in order to prepare said surface for metallic coating by electroplating; additionally surface conditioning non-conductive waxes, glass and plastic materials by making their surface electrically conductive through conventional chemical methods;

c) metallic electroplating by coating the mold with one or several metallic layers up to the desired thickness;

d) separation or destruction of the mold from the metallic container and;

e) cleaning by conventional methods followed by a heat treatment process of annealing.

2. A method as claimed in claim 1 wherein the electroplating process is carried out under current density, high bath temperature and vigorous bath stirring.

3. A method as claimed in claim 1 wherein the electroplated layer consists of alternated layers of more than one different metal.

4. A method as claimed in claim 1 where the electroplated layer consists of alternated layers of different thickness and they are alternated in as many as possible different positions according to the number of different electroplated metals.

5. A method as claimed in claim 1 wherein the mold is extracted by mechanical, thermal or chemical methods.

* * * * *